US010590920B2

(12) United States Patent
Friedrichsen et al.

(10) Patent No.: US 10,590,920 B2
(45) Date of Patent: Mar. 17, 2020

(54) PUMP DEVICE

(71) Applicant: Danfoss A/S, Nordborg (DK)

(72) Inventors: Welm Friedrichsen, Nordborg (DK); Lars Martensen, Soenderborg (DK); Frank Holm Iversen, Padborg (DK); Palle Olsen, Nordborg (DK); Stig Kildegaard Andersen, Krusaa (DK)

(73) Assignee: Danfoss A/S, Nordborg (DK)

( * ) Notice: Subject to any disclaimer, the term of this patent is extended or adjusted under 35 U.S.C. 154(b) by 321 days.

(21) Appl. No.: 14/930,738

(22) Filed: Nov. 3, 2015

(65) Prior Publication Data

US 2016/0131119 A1 May 12, 2016

(30) Foreign Application Priority Data

Nov. 11, 2014 (EP) ..... 14192642

(51) Int. Cl.
*F04B 1/22* (2006.01)
*F04B 53/10* (2006.01)
(Continued)

(52) U.S. Cl.
CPC ..... *F04B 1/22* (2013.01); *F04B 1/2021* (2013.01); *F04B 53/10* (2013.01)

(58) Field of Classification Search
None
See application file for complete search history.

(56) References Cited

U.S. PATENT DOCUMENTS 1,539,616 A * 5/1925 Williams ..... F16H 39/14 417/206
2,733,666 A * 2/1956 Poulos ..... F04B 1/2007 184/6.17
(Continued)

FOREIGN PATENT DOCUMENTS

CN 1926332 A 3/2007
CN 102135082 A 7/2011
(Continued)

OTHER PUBLICATIONS

Indian Examination Report and its English Translation for Serial No. 2676/DEL/2015 dated Dec. 28, 2018.

*Primary Examiner* — Peter J Bertheaud
*Assistant Examiner* — Geoffrey S Lee
(74) *Attorney, Agent, or Firm* — McCormick, Paulding & Huber PLLC

(57) ABSTRACT

A pump device (1) is provided comprising: a shaft (2), rotor means (3*a*, 3*b*) fixed to said shaft (2) in rotational direction, said rotor means (3*a*, 3*b*) having pressure chambers (5*a*, 5*b*) the volume of which varying during a rotation of said rotor means (3*a*, 3*b*), port plate means (15*a*, 15*b*) having a through going opening (16*a*, 16*b*) for each of said pressure chambers (5*a*, 5*b*) and being connected to said rotor means (3*a*, 3*b*) in rotational direction, and valve plate means (17*a*, 17*b*) cooperating with said port plate means (15*a*, 15*b*). It is intended to pressurize a high volume of fluid, in particular water, within a limited space. To this end said rotor means (3*a*, 3*b*) comprise a first rotor (3*a*) and at least a second rotor (3*b*), both rotors being fixed to said shaft (2) in rotational direction, said first rotor (3*a*) having at least a first pressure chamber (5*a*) and said second rotor (3*b*) having at least a second pressure chamber (5*b*), said port plate means (15*a*, 15*b*) having a first port plate (15*a*) and at least a second port plate (15*b*), said first port plate (15*a*) having a through going opening (16*a*) for said first pressure chamber (5*a*) and being connected to said first rotor (3*a*) in rotational direction, said second port plate (15*b*) having a through going opening (16*b*) for said second pressure chamber (5*b*) and being connected to said second rotor (3*b*) in rotational direction, said valve plate means (17*a*, 17*b*) having a first valve plate (17*a*) and at least a second valve plate (17*b*), said first valve plate (17*a*) cooperating with said first port plate (15*a*), and said second valve plate (17*b*) cooperating with said second
(Continued)

port plate (15*b*), wherein at least one of said first rotor (3*a*) and said second rotor (3*b*) comprises force generating means (19) pressing said second port plate (15*b*) against said second valve plate (17*b*) even in absence of hydraulic pressure in said second pressure chamber (5*b*).

15 Claims, 1 Drawing Sheet

(51) Int. Cl.
*F04B 1/20* (2020.01)
*F04B 1/2021* (2020.01)

(56) References Cited

U.S. PATENT DOCUMENTS 3,093,081 A * 6/1963 Budzich ..... F04B 1/20 417/216
3,200,762 A * 8/1965 Thoma ..... F01B 3/0035 417/488
3,406,608 A * 10/1968 Diedrich ..... F01B 3/0064 91/368
3,410,220 A 11/1968 Kratzenberg et al.
3,418,942 A * 12/1968 Partos ..... F04B 1/124 384/276
3,596,568 A * 8/1971 Wittren ..... F01B 3/0032 91/472
4,007,663 A * 2/1977 Nagatomo ..... F04B 1/2021 417/269
4,117,768 A * 10/1978 Affouard ..... F04B 1/124 91/499
4,481,867 A * 11/1984 Nagase ..... F04B 1/2035 91/487
4,508,011 A * 4/1985 Nolden ..... F04B 1/2064 417/222.1
4,624,175 A * 11/1986 Wahlmark ..... F01B 3/0047 60/487
6,000,316 A 12/1999 Møller et al.
6,551,083 B2 8/2003 Weisener et al.
2005/0095144 A1* 5/2005 Shimizu ..... F01B 3/0035 417/244
2013/0209284 A1* 8/2013 Dreher ..... F03C 1/0686 417/218
2014/0186196 A1* 7/2014 Mizoguchi ..... F03C 1/0671 417/269
2015/0059328 A1* 3/2015 Suzuki ..... E02F 9/202 60/419
2015/0064030 A1* 3/2015 Suzuki ..... F04B 17/03 417/372
2015/0211396 A1* 7/2015 Tsuji ..... F04B 1/22 92/153
2015/0240637 A1* 8/2015 Kato ..... F04B 1/02 92/12.2

FOREIGN PATENT DOCUMENTS

CN 103882905 A 6/2014
DE 43 01 133 A1 7/1994
DE 44 24 609 A1 1/1996
DE 10 2008 044 869 A1 3/2010
WO 03/058035 A1 7/2003
WO 03058034 A1 7/2003
WO 2011/161178 A1 12/2011

* cited by examiner

PUMP DEVICE

CROSS REFERENCE TO RELATED APPLICATIONS

Applicant hereby claims foreign priority benefits under U.S.C. § 119 from European Patent Application No. EP 14192642 filed on Nov. 11, 2014, the contents of which are incorporated by reference herein.

TECHNICAL FIELD

The present invention relates to a pump device comprising: a shaft, rotor means fixed to said shaft in rotational direction, said rotor means having pressure chambers the volume of which varying during a rotation of said rotor means, port plate means having a through going opening for each of said pressure chambers and being connected to said rotor means in rotational direction, and valve plate means cooperating with said port plate means.

BACKGROUND

When in such a pump device the shaft is driven in rotational direction the rotor means are rotated thereby increasing and decreasing the volume of the pressure chambers. When the volume of the pressure chambers increases liquid is sucked from an inlet and when the volume of the pressure chambers decreases this liquid is outputted through an output. The number of the pressure chambers and the accumulated volume of the pressure chambers define the displacement of the pump means.

The invention relates in particular to a water hydraulic pump device, i.e. a pump device with which water can be pumped and with which the pressure of the water can be considerably increased so that the water can be supplied to a reverse osmosis unit. In this case the water can be purified, for example, to gain drinking water from salt water. In such reverse osmosis applications usually a large amount of water has to be pumped. To this end it is necessary to have a large number of pump devices which makes the whole arrangement expensive. Furthermore, each pump device together with a corresponding driving motor requires a certain space. Therefore, for a high volume of fluid to be pressurized a considerable space is necessary.

SUMMARY

The object underlying the invention is to pressurize a high volume of fluid, in particular water, within a limited space.

This object is solved with a pump device as described at the outset in that said rotor means comprise a first rotor and at least a second rotor, said rotors being fixed to said shaft in rotational direction, said first rotor having at least a first pressure chamber and said second rotor having at least a second pressure chamber, said port plate means having a first port plate and at least a second port plate, said first port plate having a through going opening for said first pressure chamber and being connected to said first rotor in rotational direction, said second port plate having a through going opening for said second pressure chamber and being connected to said second rotor in rotational direction, said valve plate means having a first valve plate and at least a second valve plate, said first valve plate cooperating with said first port plate, and said second valve plate cooperating with said second port plate, wherein at least one of said first and said second rotor comprises force generating means pressing said second port plate against said second valve plate even in absence of hydraulic pressure in said second pressure chamber.

Such a pump device comprises in other words two pump units mounted on the same shaft. When the shaft is rotated, both pump units are operated simultaneously. Each pump unit has its own rotor, its own port plate and its own valve plate. Since both pump units are mounted on the same shaft, they are not only operationally linked together, but also mechanically. This could cause a problem during starting of the pump device. When the pump device is operating, the port plate and the valve plate in each pump unit must be pressed against each other with a force, wherein said force must be in a clearly defined range. When the force is too small, leakage occurs between the valve plate and the port plate. When the force is too high friction occurs leading to wear and mechanical losses. In pump devices with only one pump unit the force pressing the valve plate and the port plate against each other is generated by a hydraulic pressure in the pressure chamber or pressure chambers. This is also possible in the pump device according to the present invention. However, when the pump device is started, there is no pressure or not sufficient pressure available to press the first port plate and the first valve plate together and simultaneously the second port plate and the second valve plate together. Therefore, in at least one of the pairs of port plate and valve plate leakage could occur preventing properly starting of the pump device. This problem is removed by providing force generating means which act independently of the pressure in the pressure chamber, in particular independent of hydraulic pressure in the second pressure chamber.

The pump device can, of course, have more than two rotors. In this case all but one rotor comprise these force generating means pressing the respective port plate against the respective valve plate. Only one rotor can be constructed without such force generating means.

Preferably said force generating means comprise at least one spring. A spring is a relatively simple constructional element having the ability to generate the required force. The spring can be dimensioned so that the force is just sufficient to produce the required forces during the starting of the pump device. It does not dramatically increase the forces during operation so that the spring does not really influence the operational behavior of the pump device during normal operation.

Preferably said spring is a coil spring located in a pocket of said second rotor. The pocket can guide the coil spring to prevent a lateral deformation of the coil spring.

Preferably said shaft extends from said first rotor to said second rotor and said first rotor and said second rotor are fixed in axial direction to said shaft. The shaft is a through going shaft and both rotors are rigidly connected to this shaft.

Preferably a port housing is located between said first rotor and said second rotor. The port housing is common for both pump units thereby simplifying the construction.

Preferably said first valve plate and said second valve plate are located on opposite sides of said port housing. During operation the port housing receives fluid under pressure from opposite side so that the pressures, at least in part, can equalize each other.

Preferably said shaft extends freely to said port housing. There is no bearing necessary in the housing. The shaft can be guided through the port housing without any contact to the port housing.

In a preferred embodiment a distance sleeve surrounding said shaft is located between said first rotor and said second rotor. This distance sleeve defines a distance between the two rotors. This distance is adapted to the axial extend of the port housing, the valve plates and the port plates.

In a preferred embodiment said first pressure chamber is formed by a first cylinder and a first piston and said second pressure chamber is formed by a second cylinder and a second piston, said first piston and said second piston being moveable in a direction parallel to said axial direction of said shaft. The first rotor is in the form of a first cylinder drum and the second rotor is in form of a second cylinder drum. Both pump units therefore have the form of an axial piston pump. During a rotation of the first cylinder drum and the second cylinder drum the first piston (or first pistons) and the second piston (or second pistons) move in axial direction forth and back thereby pumping liquid.

Preferably said first piston is driven by a first swash plate and said second piston is driven by a second swash plate, said swash plates having opposite angles of inclination. This does not mean that the swash plates must be arranged exactly opposite to each other. However, the opposite angles of inclination provoke a simultaneous movement of the first piston and the second piston in opposite direction thus keeping the resulting force in the pumps device small.

In this case it is preferred that said first piston has a first slide shoe held in contact at said first swash plate by means of a first pressure plate swiveling about a first swivel and said second piston has a second slide shoe held in contact at said second swash plate by means of a second pressure plate swiveling about a second swivel, said first rotor being supported in a first rotor housing by means of a first bearing arranged between said first swivel and said port housing and said second rotor being supported in a second rotor housing by means of a second bearing arranged between said second swivel and said port housing. This construction has a number of advantages. The shaft is supported via the rotors and the bearing at two points having a considerable distance to each other. Therefore, the shaft is supported with a rather high stability. Tilting of the shaft can be reliably prevented. Furthermore, the bearing can act on a smaller diameter of the rotor since it is not longer necessary to position the bearing in a plane in which the respective swivel is arranged. This saves the material and therefore costs during production. Furthermore, the costs for operation can be reduced as well since a smaller radius of the bearing produces smaller losses of the torque.

In a preferred embodiment at least one of said rotors is clamped onto said shaft. This clamping can be achieved using a cone and a corresponding counter cone.

Alternatively or additionally said shaft for at least one of said rotors has a polygon shaped outer contour and said one of the rotors has a corresponding polygon shaped inner contour. This polygon shaped contour can have the form of a spline. However, it can as well have the form of a triangle, rectangle or the like. The polygon contour can also have rounded edges. It just has a form to prevent a rotational movement between the shaft and the respective rotor.

In this case it is preferable that a sleeve made of a plastic material is arranged between said rotor and said shaft. In particular, when the polygon contour is not a spline, there is the risk of a small movement between the rotor and the shaft during operation. When the pump device is used for pumping water under high pressure such a relative movement would produce considerable wear. This wear can be avoided using a sleeve of plastics materials. Examples for such materials are materials from the group of high-strength thermoplastic plastics materials on the basis of polyaryl ether ketones, in particular polyether ether ketones, polyamides, polyacetals, polyaryl ethers, polyethylene terephtalates, polyphenylene sulphides, polysulphones, polyether sulphones, polyether imides, polyamide imide, polyacrylates, phenol resins, such as novolak resins, or similar substances, and as fillers, use can be made of glass, graphite, polytetrafluoro-ethylene or carbon, in particular in fibre form. When using such materials, it is likewise possible to use water as the hydraulic fluid.

BRIEF DESCRIPTION OF THE DRAWINGS

Preferred examples of the present invention will now be described in more detail with reference to the drawing, wherein.

DETAILED DESCRIPTION

Figure 1:
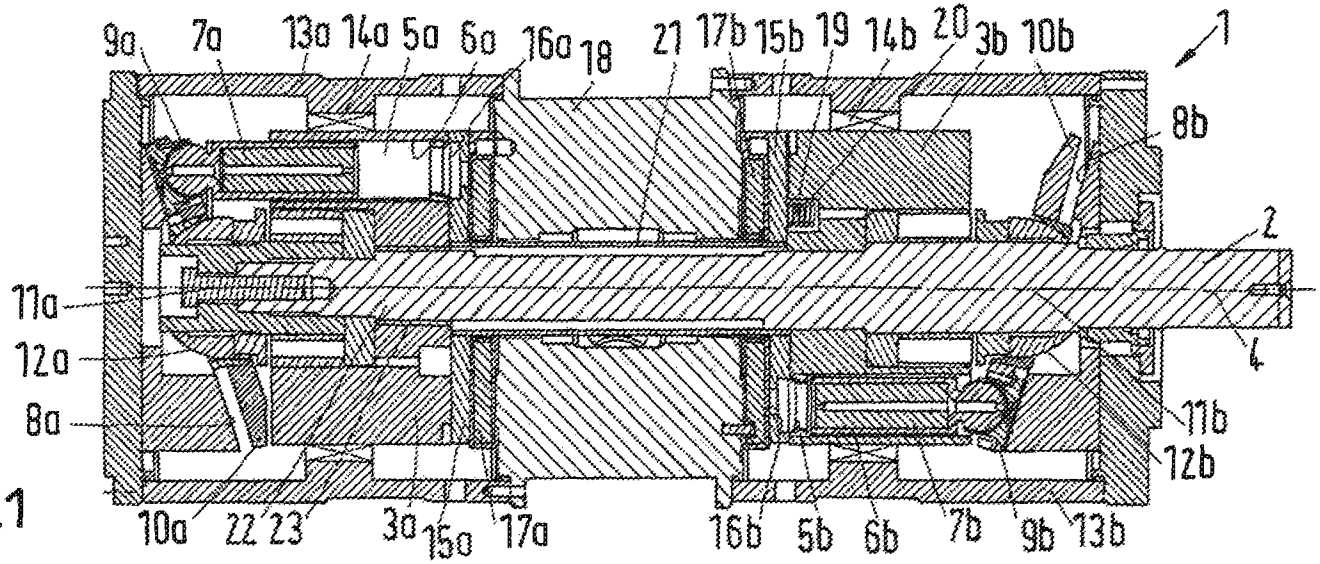
FIG. 1 is a schematic sectional view of a first embodiment of a pump device and FIG. 2 is a schematic sectional view of a second embodiment of a pump device.

A pump device 1 is used for pumping water. It is a water hydraulic machine and comprises a shaft 2 which can be rotated by a motor which is not shown. The shaft 2 is a through going shaft extending over almost the complete length of the pump device 1. A first rotor 3*a* and a second rotor 3*b* are fixed to the shaft 2 in rotational direction and in axial direction of the shaft 2. The axial direction refers to a rotational axis 4 of the shaft 2.

The first rotor 3*a* has a plurality of first pressure chambers 5*a*. Each pressure chamber 5*a* is formed by a first cylinder 6*a* and a first piston 7*a* which is during operation moveable parallel to the axis 4 of the shaft 2. Therefore, the volume of the first pressure chamber 5*a* varies during a rotation of the shaft 2 between a maximum size and a minimum size.

A first swash plate 8*a* is located facing a front face of the first rotor 3*a*. Each first piston 7*a* is provided with a first slide shoe 9*a*. The slide shoe 9*a* is held in contact with the swash plate 8*a* by means of a pressure plate 10*a* swiveling about a first swivel 11*a* during rotation of the first rotor 3*a*. To this end the first pressure plate 10*a* is supported on a first sphere 12*a* fixed to the first rotor 3*a*.

The first rotor 3*a* is surrounded by a first rotor housing 13*a*. The first rotor 3*a* is supported in the first rotor housing 13*a* by means of a first radial bearing 14*a*.

At the side of the first rotor 3*a* opposite to the first swash plate 8*a* a first port plate 15*a* is located having a through going opening 16*a* for each first pressure chamber 5*a*. The first port plate 15*a* contacts a first valve plate 17*a*. The valve plate 17*a* has kidney-shaped openings serving as inlet and outlet openings for a first pump unit formed by said first rotor 3*a*, said first pressure chamber 5*a*, said first swash plate 8*a*, said first slide shoe 9*a*, said first pressure plate 10*a*, said first sphere 12*a*, said first port plate 15*a* and said first valve plate 17*a*.

The pump device 1 comprises furthermore a second pump unit which is constructed similar to the first pump unit, i.e. comprising a second rotor 3*b*, second pressure chambers 5*b* each formed of a second cylinder 6*b* and a second piston 7*b*. The second piston 7*b* is driven by a second swash plate 8*b*. Each second piston 7*b* is provided with a second slide shoe 9*b* and is held in contact at the swash plate 8*b* by means of a second pressure plate 10*b* swiveling during operation around a second swivel 11*b*. To this end the second pressure plate 10*b* is supported on a second sphere 12*b*. The second rotor 3*b* is surrounded by a second rotor housing 13*b* and supported in the second rotor housing 13*b* by means of a second radial bearing 14*b*.

The second rotor 3*b* is provided with a second port plate 15*b* having a through going opening 16*b* for each pressure chamber 15*b*. The port plate 15*b* cooperates with a second valve plate 17*b* having the same construction as the first valve plate 17*a*.

The first swash plate 8*a* and the second swash plate 8*b* have opposite inclination. During rotation of the shaft 2 the first piston 7*a* and the second piston 7*b* move simultaneously in opposite directions keeping resulting forces small.

The first swash plate 8*a* and the second swash plate 8*b* may have the same angle or different angles of indination.

A port housing 18 is located between the first rotor 3*a* and the second rotor 13*b*. The port housing 18 accommodate a common inlet port and a common outlet port for the two pump units. Since the two pistons 7*a*, 7*b* are permanently moving in opposite direction the port housing 18 is loaded by opposite acting pressures. Therefore, the port housing 18 is balanced.

The first radial bearing 14*a* is located in axial direction between the first swivel 11*a* and the port housing 18. The second radial bearing 14*b* is located in axial direction between the second swivel 11*b* and the port housing 18. The first radial bearing 14*a* and the second radial bearing 14*b* have a considerable distance to each other in axial direction giving stable support for the shaft 2 thereby preventing tilting of the shaft 2 and of the first rotor 3*a* and of the second rotor 3*b*. The radial bearings 14*a*, 14*b* can be designed to support the rotors 3*a*, 3*b* axially as well. However, separate axial bearings can be used as well.

During operation the first port plate 15*a* is pressed against the first valve plate 17*a* by the pressure in the first pressure chamber 15*a*. In the same way, during operation the second port plate 15*b* is pressed against the second valve plate 17*b* by the pressure in the second pressure chamber 5*b*.

However, this requires that the pressure in both pressure chambers 5*a*, 5*b* is high enough to generate forces sufficient to establish a leak proof seal between the first port plate 15*a* and the first valve plate 17*a* and between the second port plate 15*b* and the second valve plate 17*b*. Such a pressure does not exist when the shaft 2 is not rotated. In particular, such a pressure does not exist during a starting of the pump device 1.

In order to press the second port plate 15*b* against the second valve plate 17*b* even when there is not enough pressure in the second pressure chamber 5*b* a coil spring 19 is arranged between the second rotor 3*b* and the second port plate 15*b*. This coil spring 19 is located in a pocket 20 in the second rotor 3*b* guiding the coil spring 19 and preventing a deformation in lateral direction.

It is noted that the coil spring 19 as force generating means is necessary in one of the two pump units only. The first pump unit does not have such a force generating means. However, it is possible to provide both pump units with force generating means, such as said coil spring 19.

In most cases it will be necessary to use more than only one coil spring 19. In this case the coil springs are distributed in circumferential direction around axis 4. It is possible to use, for example, 3, 6, or 9 coil springs 19 depending on the force each coil spring 19 can generate.

Generally speaking, if not only two pump units, as shown, are used, but N-pump units, (N−1) pump units must have such a force generating means like coil spring 19 whereas the remaining pump unit does not have such a force generating means.

As mentioned above, the two rotors 3*a*, 3*b* are fixed on the shaft 2 in rotational and in axial direction. To define a predetermined distance between the two rotors 3*a*, 3*b* in axial direction, a distance sleeve 21 is located between the first rotor 3*a* and the second rotor 3*b*. Both rotors 3*a*, 3*b* contact the distance sleeve 21.

As can be seen in FIG. 1 the shaft 2 extends through the port housing 18 without any contact to the port housing 18. This is possible due to the radial bearings 14*a*, 14*b* supporting sufficiently the shaft 2 via the first rotor 3*a* and the second rotor 3*b*.

The shaft 2 has a section 22 having a polygon shaped outer contour, for example in form of a triangle having rounded edges. The first rotor 3*a* is provided with a corresponding inner contour. A sleeve 23 made of a plastic material is located between the section 23 and the first rotor 3*a*. The material for this sleeve can be selected from the group of high-strength thermoplastic material on the basis of polyaryl ether ketones, in particular polyether ether ketones, polyamides, polyacetals, polyaryl ethers, polyethylene terephtalates, polyphenylene sulphides, polysulphones, polyether sulphones, polyether imides, polyamide imide, polyacrylates, phenol resins, such as novolak resins, or similar substances, and as fillers, use can be made of glass, graphite, polytetrafluoro-ethylene or carbon, in particular in fibre form. When using such materials, it is likewise possible to use water as the hydraulic fluid.

The second rotor 3*b* can be fixed on the shaft 2 in the same way. This is not shown in detail in FIG. 1.

Since the radial bearings 14*a*, 14*b* are located between the swivel 11*a*, 11*b* and the port housing 18 it is possible to use radial bearings 14*a*, 14*b* with a smaller diameter thus keeping the torque losses smaller. Furthermore, it is no longer necessary to provide the rotors 3*a*, 3*b* with a skirt surrounding the pressure plates 10*a*, 10*b*.

Figure 2:
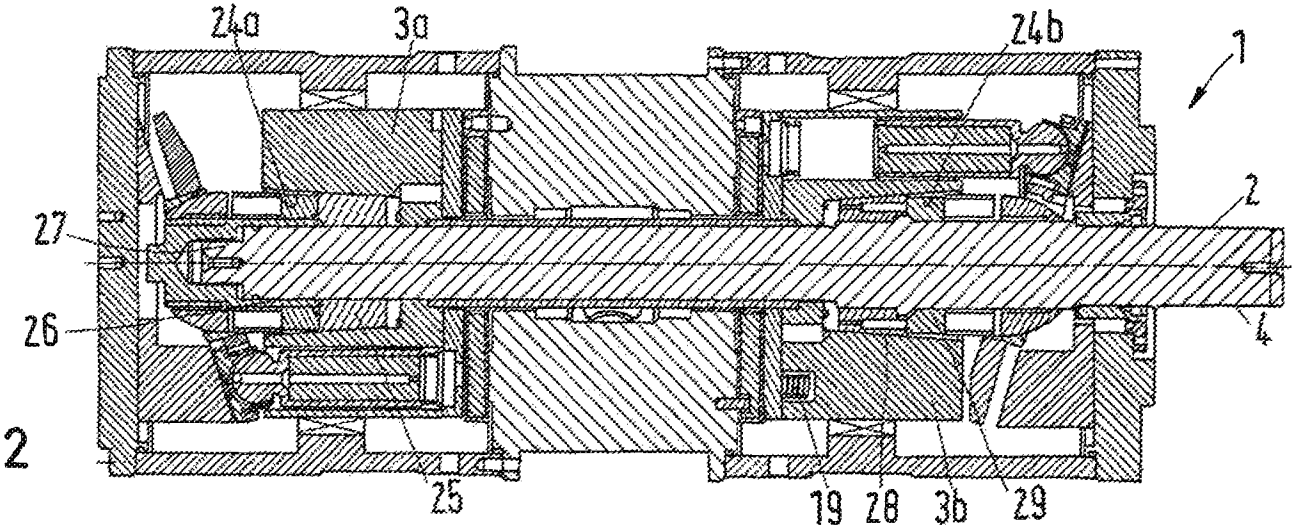

FIG. 2 shows another example of a pump device 1. The same elements are designated with the same reference numerals.

Basically the pump device 1 of FIG. 2 has the same construction as the pump device 1 of FIG. 1. One difference is the way of fixing the first rotor 3*a* to the shaft 2 and of the second rotor 3*b* to the shaft 2.

The first rotor 3*a* is provided with a cone-shaped opening 24*a* surrounding the shaft 2. A ring 25 which is provided with an axial running slot (not shown) and having a cone-like outer form, is mounted on the shaft 2 and inserted in the opening 24*a*. The ring 25 is pressed in the cone-shaped opening 24*a* by means of a pressing sleeve 26 which is screwed onto shaft 2. To this end shaft 2 is provided with an outer threading 27 at its end.

A similar construction can be used for the second rotor 3*b* having a cone-shaped opening 24*b* as well surrounding shaft 2. A slotted ring 28 is held in its position by a stop member 29. When the tightening sleeve 26 is tightened the stop member 29 presses the slotted ring 28 into the cone-shaped opening 24 thereby clamping the second rotor 3*b* on shaft 2.

It is clear that one rotor 3*a* can be fixed on shaft 2 by a polygonal geometry and the other rotor 3*b* can be clamped on the shaft 2. In principle all combinations are possible.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A pump device comprising: a shaft, rotor means fixed to said shaft in rotational direction, said rotor means having pressure chambers the volume of which varying during a rotation of said rotor means, port plate means having a through going opening for each of said pressure chambers and being connected to said rotor means in rotational direction, and valve plate means cooperating with said port plate means, wherein said rotor means comprise a first rotor and at least a second rotor, said rotors being fixed to said shaft in rotational direction, said first rotor having at least a first pressure chamber and said second rotor having at least a second pressure chamber, said port plate means having a first port plate and at least a second port plate, said first port plate having a through going opening for said first pressure chamber and being connected to said first rotor in rotational direction, said second port plate having a through going opening for said second pressure chamber and being connected to said second rotor in rotational direction, said valve plate means having a first valve plate and at least a second valve plate, said first valve plate cooperating with said first port plate, and said second valve plate cooperating with said second port plate, wherein at least one of said first and said second rotor comprises force generating means pressing said second port plate against said second valve plate even in absence of hydraulic pressure in said second pressure chamber, wherein a port housing is located between said first rotor and said second rotor, wherein said shaft extends freely through said port housing without contacting said port housing via a bearing within said port housing, and wherein said first valve plate, said second valve plate, said first port plate, said second port plate and said port housing are separate elements.

2. The pump device according to claim 1, wherein said force generating means comprise at least one spring.

3. The pump device according to claim 2, wherein said spring is a coil spring located in a pocket of said second rotor.

4. The pump device according to claim 3, wherein said shaft extends from said first rotor to said second rotor and said first rotor and said second rotor are fixed in axial direction to said shaft.

5. The pump device according to claim 2, wherein said shaft extends from said first rotor to said second rotor and said first rotor and said second rotor are fixed in axial direction to said shaft.

6. The pump device according to claim 1, wherein said shaft extends from said first rotor to said second rotor and said first rotor and said second rotor are fixed in axial direction to said shaft.

7. The pump device according to claim 1, wherein said first valve plate and said second valve plate are located on opposite sides of said port housing.

8. The pump device according to claim 1, wherein a distance sleeve surrounding said shaft is located between said first rotor and said second rotor.

9. The pump device according to claim 8, wherein said distance sleeve extends through said port housing.

10. The pump device according to claim 8, wherein said distance sleeve is in contact with said first rotor and said second rotor.

11. The pump device according to claim 1, wherein said first pressure chamber is formed by a first cylinder and a first piston and said second pressure chamber is formed by a second cylinder and a second piston, said first piston and said second piston being movable in a direction parallel to said axial direction of said shaft.

12. The pump device according to claim 11, wherein said first piston is driven by a first swash plate and said second piston is driven by a second swash plate, said swash plates having opposite angels of inclination.

13. The pump device according to claim 12, wherein said first piston has a first slide shoe held in contact at said first swash plate by a first pressure plate swiveling about a first swivel and said second piston has a second slide shoe held in contact at said second swash plate by a second pressure plate swiveling about a second swivel, said first rotor being supported in a first rotor housing by a first bearing arranged between said first swivel and said port housing and said second rotor being supported in a second rotor housing by a second bearing arranged between said second swivel and said port housing.

14. The pump device according to claim 1, wherein at least one of said rotors is clamped onto said shaft.

15. The pump device according to claim 1, wherein a sleeve made of a plastic material is arranged between said rotor and said shaft.

* * * * *